US011938532B2

(12) United States Patent
Batt

(10) Patent No.: US 11,938,532 B2
(45) Date of Patent: Mar. 26, 2024

(54) APPARATUS AND METHOD FOR AUTOMATED APPLICATION OF RIVETS

(71) Applicant: THE BOEING COMPANY, Chicago, IL (US)

(72) Inventor: Edward J. Batt, Mount Pleasant, SC (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 17/483,311

(22) Filed: Sep. 23, 2021

(65) Prior Publication Data

US 2023/0095667 A1 Mar. 30, 2023

(51) Int. Cl.
*B21J 15/44* (2006.01)
*B21J 15/32* (2006.01)

(52) U.S. Cl.
CPC ..... *B21J 15/44* (2013.01); *B21J 15/32* (2013.01)

(58) Field of Classification Search
CPC ... B21J 15/10; B21J 15/44; B21J 15/32; B21J 15/145; B23P 19/10
See application file for complete search history.

(56) References Cited

U.S. PATENT DOCUMENTS 6,106,446 A * 8/2000 Kelly ..... B21J 15/36 29/788
10,723,484 B2 * 7/2020 Chan ..... B21J 15/30

* cited by examiner

*Primary Examiner* — Christopher J Besler
(74) *Attorney, Agent, or Firm* — ALSTON & BIRD LLP

(57) ABSTRACT

An apparatus for automated application of rivets to a part is described, in which an operator is not required to manually align a rivet gun with each hole to be riveted or to manually squeeze the rivet into place. The apparatus includes a frame assembly, a tool positioning assembly attached to the frame assembly, and a movable tool assembly engaged with the tool positioning assembly and configured to be moved with respect to the tool positioning assembly. The tool positioning assembly is adjustable to correspond with a position of a number of rivet holes on a part to be riveted. In this way, the movable tool assembly is able to sequentially align with each of a number of rivet holes via alignment with the tool positioning assembly and to apply a rivet to each of the rivet holes.

20 Claims, 18 Drawing Sheets

APPARATUS AND METHOD FOR AUTOMATED APPLICATION OF RIVETS

TECHNOLOGICAL FIELD

Apparatuses and methods are described for automated application of rivets for fastening parts. In particular, solutions are described that position a rivet in alignment with a rivet hole, apply the rivet, and advance the rivet operation to the next rivet hole in an automated fashion.

BACKGROUND

Rivets are mechanical fasteners that are used in manufacturing to permanently hold together two plates of metal. In particular, pre-formed holes (e.g., punched or drilled holes) in the two pieces to be fastened are put into alignment, then the rivet pin or shank of the rivet is inserted into the hole. The headless end of the rivet is then beaten out or pressed down (e.g., expanding to about 1.5 times the original shank diameter) to hold the rivet in place within the aligned holes, thereby fastening the two pieces.

In the aerospace industry, for example, rivets are commonly used to hold plates of metal together. With increased attention being given to employee safety and the inherent differences in the skills, strengths, and techniques of operators of conventional riveting systems, there is a need for improved apparatuses and methods for applying rivets in an accurate, reliable, and safe manner.

BRIEF SUMMARY

Embodiments of the invention described herein aim to address the problems identified by the inventor with respect to conventional rivet tools, particularly with respect to rivet tools used in the aerospace industry, although the tools described herein may be used in a number of contexts for applying rivets to parts used in various industries other than the aerospace industry, such as in shipbuilding and the electronics industry. In particular, embodiments of the apparatuses and methods described herein provide mechanisms to apply a large number of rivets to parts to be fastened without requiring an operator to manually align and apply each rivet. Rather, embodiments of the apparatuses and methods described herein automatically position the rivet tool with respect to the parts to be fastened, apply the rivet to a first aligned hole in the parts, then advance the rivet tool to the next aligned hole set to repeat the process. In such a manner, a large number of rivets may be applied automatically to produce a soundly fastened product with minimized risk of defects while also reducing the ergonomic impact on the operator.

Accordingly, embodiments of the present invention provide an apparatus for automated application of rivets to a part, where the apparatus comprises a frame assembly, a tool positioning assembly attached to the frame assembly, and a movable tool assembly engaged with the tool positioning assembly and configured to be moved with respect to the tool positioning assembly. The tool positioning assembly may be configured to be adjusted to correspond with a position of a plurality of rivet holes on a part to be riveted. The movable tool assembly may be configured to sequentially align with each of the plurality of rivet holes via alignment with the tool positioning assembly and to apply a rivet to each of the plurality of rivet holes.

In some embodiments, the frame assembly may comprise a central support member and a peripheral support member affixed to the central support member, and the tool positioning assembly may be attached to the peripheral support member. The tool positioning mount may define a circular shape.

In some cases, the tool positioning assembly may comprise a plurality of tool positioning modules. In such embodiments, each tool positioning module may comprise a locking cone, and the movable tool assembly may comprise a locking cone receiver configured to be moved into engagement with each locking cone. Engagement of the locking cone receiver with each of the plurality of locking cones may thus position the movable tool assembly in alignment with a corresponding one of the plurality of rivet holes for applying a rivet to the respective rivet hole.

In some embodiments, an axial displacement of each of the plurality of locking cones may be independently adjustable with respect to an axial displacement of other locking cones. Additionally or alternatively, an angle and an elevation of each locking cone assembly may be independently adjustable with respect to an angle and an elevation of other locking cone assemblies. In some cases, the movable tool assembly may be self-adjustable with respect to at least one of a longitudinal axis, a roll axis, or a pitch axis of the movable tool assembly upon engagement of the locking cone receiver with a corresponding locking cone, such that self-adjustment results in normalization of the movable tool assembly with respect to a surface of the part to be riveted at a location of the respective rivet hole.

In some embodiments, the movable tool assembly may comprise a T-bearing shoe, and each locking cone assembly may comprise a track configured to slidably receive the T-bearing shoe. Each tool positioning module may comprise a pair of extensions, and each extension may comprise a foot. In such cases, the pair of extensions and feet may form a track for slidably receiving the T-bearing shoe.

The T-bearing shoe may, in some cases, comprise a fixed portion, a movable portion spaced from and movable with respect to the fixed portion, and a compression spring attached to the fixed portion and the movable portion and disposed therebetween.

In some embodiments, the movable tool assembly may be pneumatically, electrically, or hydraulically actuated.

In some embodiments, the frame assembly may be configured to be moved between a non-operational position in which the apparatus is spaced from the part to be riveted and an operational position in which the apparatus is engageable with the part to be riveted.

The movable tool assembly may, in some embodiments, comprise a C-frame configured to be attached to a rivet squeezer. The C-frame may comprise a hinge and may be configured to be moved between an open position and a closed position via rotation about the hinge. In the open position, the C-frame may be configured to receive the part to be riveted. The C-frame may, in some embodiments, further comprise an anvil, such that in the closed position actuation of the rivet squeezer moves the rivet into contact with the anvil for deforming the rivet during a riveting operation.

In some cases, the part to be riveted is an engine inlet assembly.

In other embodiments, a method for automated application of rivets to a part is provided. The method may comprise the steps of preparing a part for a riveting operation by inserting a plurality of rivets into a corresponding plurality of holes defined by the part; positioning a riveting apparatus in alignment with a first hole to be riveted; applying a first rivet to the first hole; automatically advancing the riveting apparatus to be in alignment with a second hole to be riveted; and applying a second rivet to the second hole. In some cases, the method may sequentially apply each of the plurality of rivets to a corresponding one of the plurality of holes to mechanically fasten the part.

In some embodiments, the riveting apparatus may comprise a frame assembly, a tool positioning assembly attached to the frame assembly, and a movable tool assembly engaged with the tool positioning assembly and configured to be moved with respect to the tool positioning assembly. Positioning the riveting apparatus in alignment with the first hole to be riveted may, in some cases, comprise lowering the frame assembly into engagement with the part to be riveted. Positioning the riveting apparatus in alignment with the first hole to be riveted may, additionally or alternatively, comprise adjusting the tool positioning assembly to correspond with a position of the plurality of rivet holes on the part to be riveted.

In some cases, applying the first rivet to the first hole may comprise moving a locking cylinder to an operational position, thereby locking the movable tool assembly with respect to the tool positioning assembly for alignment with the first hole; moving a rivet cylinder to the operational position, thereby applying the first rivet to the first hole by actuating a rivet squeezer to apply the rivet; moving the rivet cylinder to a non-operational position, thereby disengaging the riveting apparatus from the first rivet and the first rivet hole; and moving the locking cylinder to a non-operational position, thereby allowing the movable tool assembly to be advanced to the second hole. In some embodiments, each of the locking cylinder, the rivet cylinder, and the move cylinder may be pneumatically, electrically, or hydraulically actuated. In some cases, automatically advancing the riveting apparatus to be in alignment with a second hole to be riveted may comprise actuating a move cylinder to advance the movable tool assembly into alignment with the second hole.

BRIEF DESCRIPTION OF THE DRAWINGS

Figure 1:
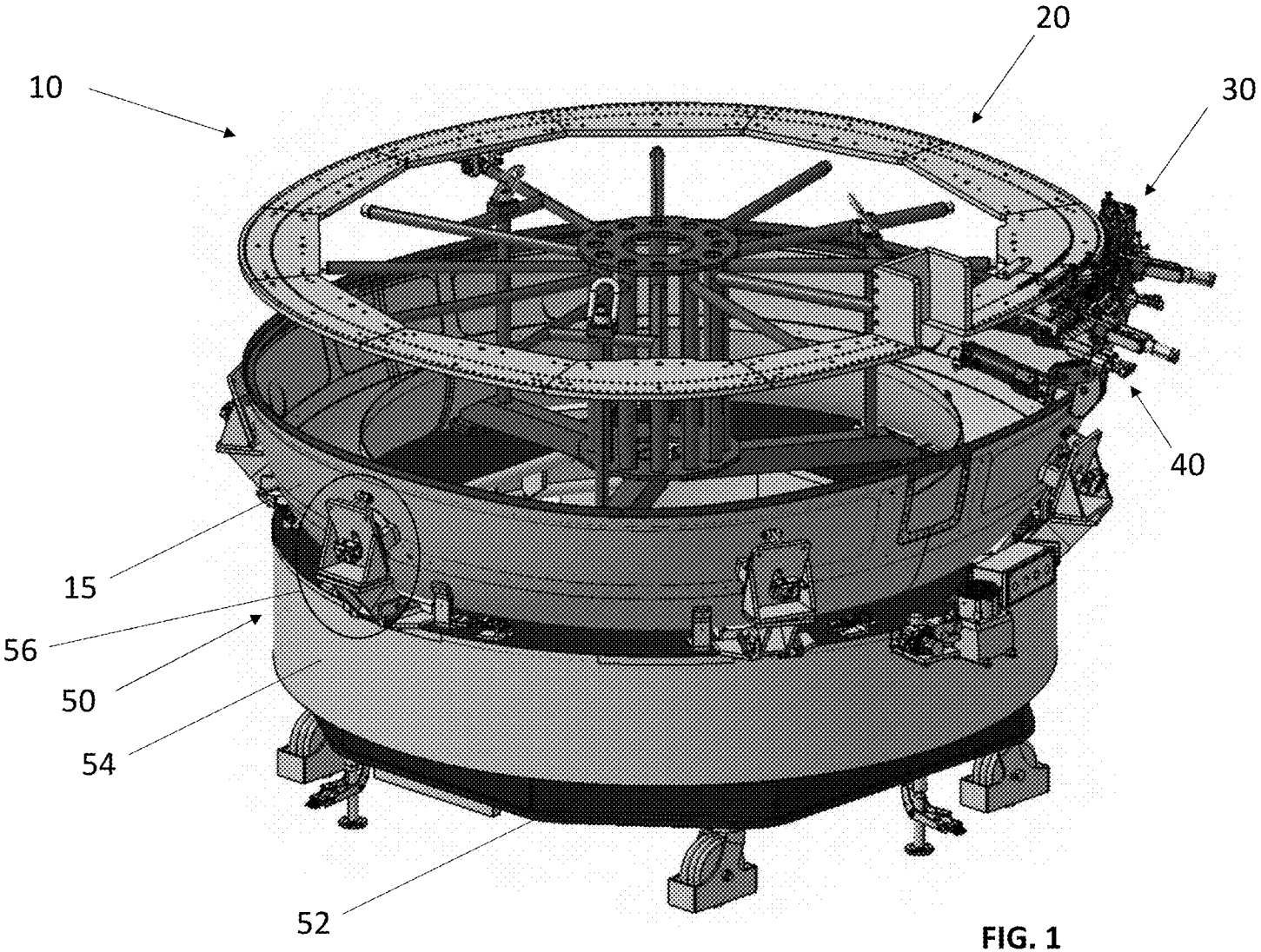
Figure 1A:
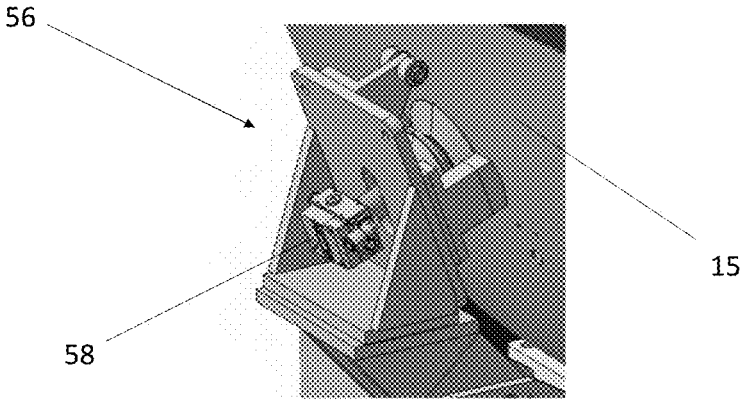
Figure 2A:
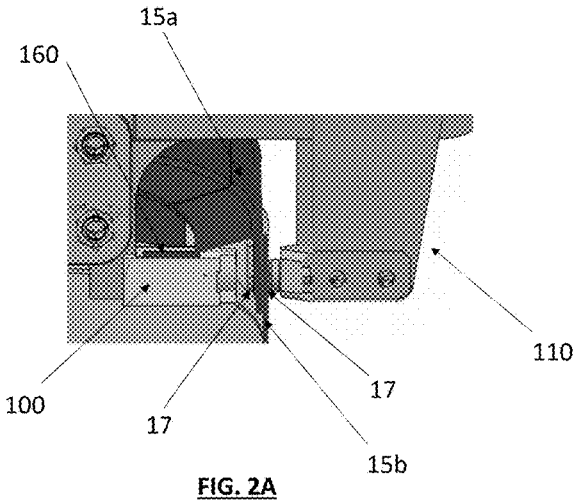
Figure 2B:
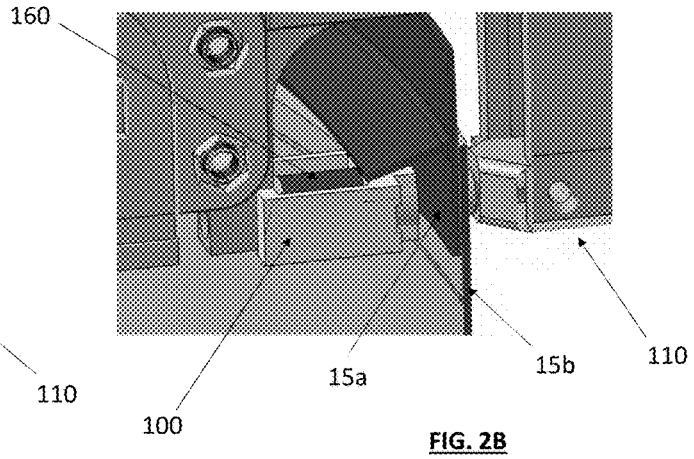
Figure 3:
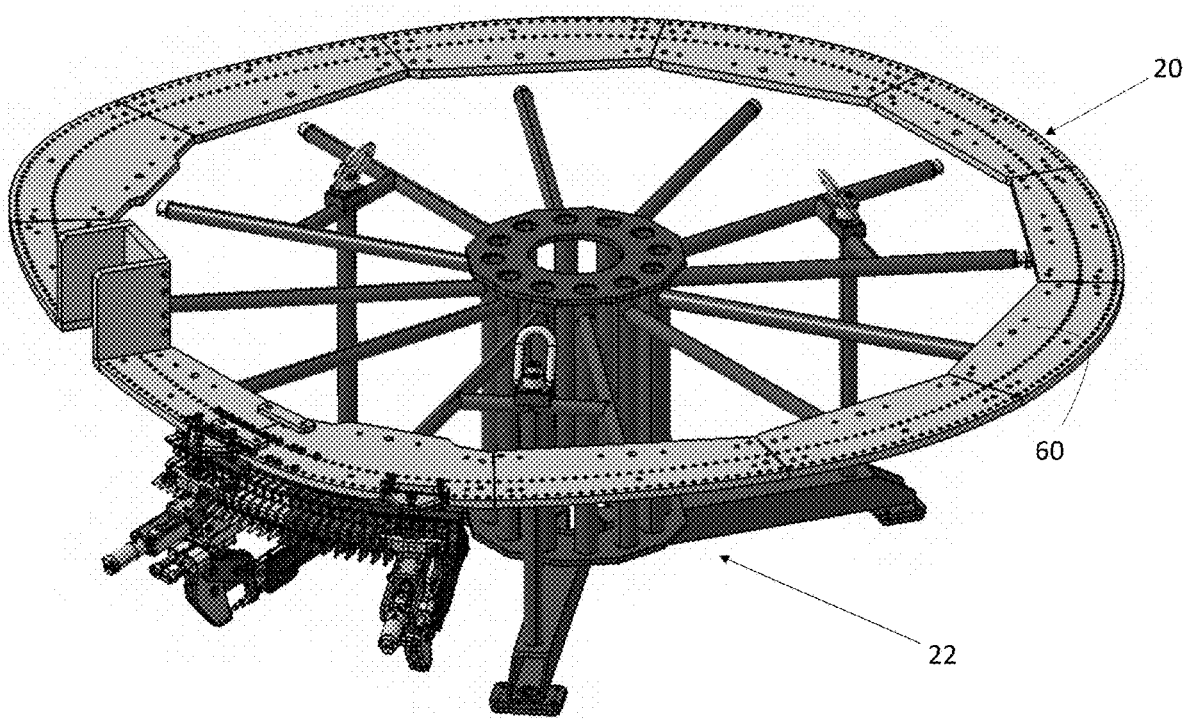
Figure 4:
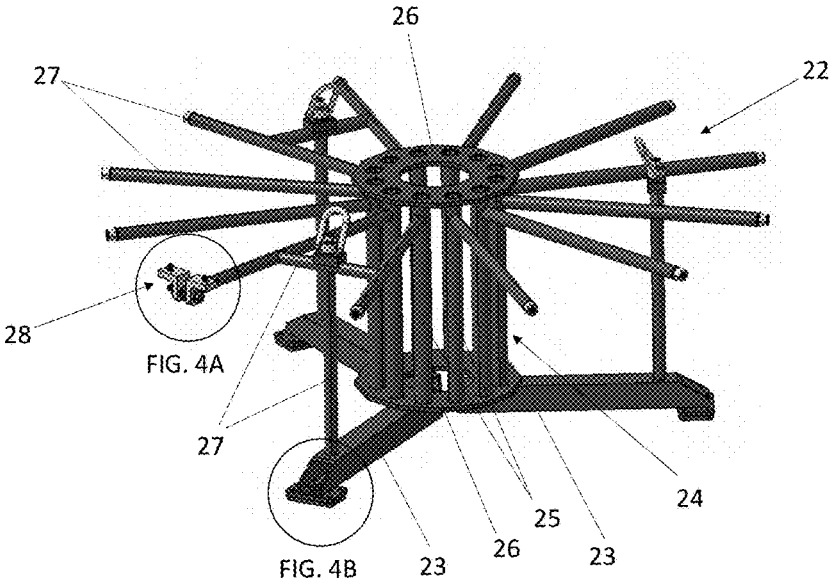
Figure 4A:
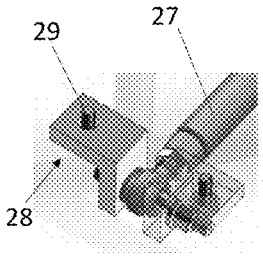
Figure 4B:
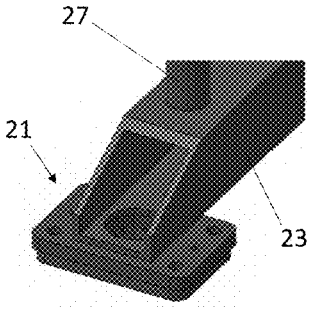
Figure 4C:
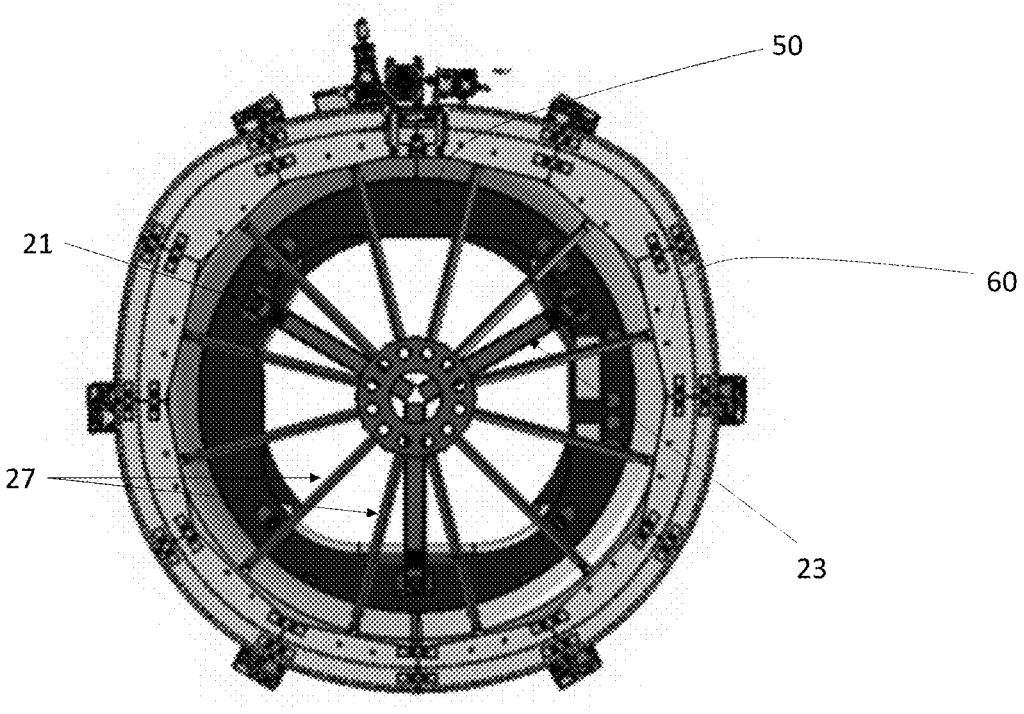
Figure 5:
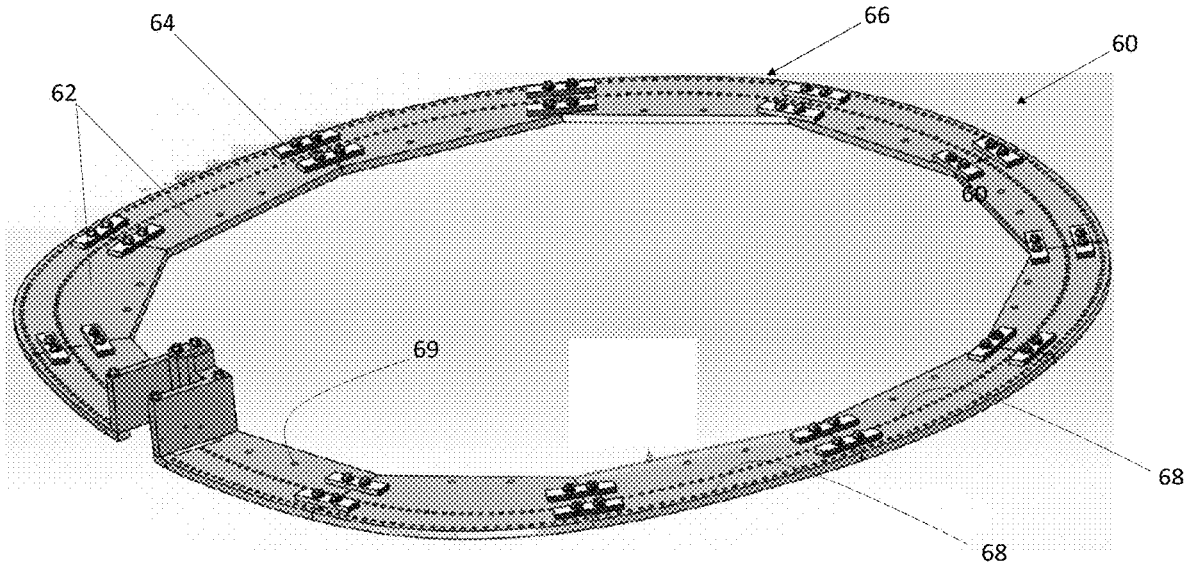
Figure 6:
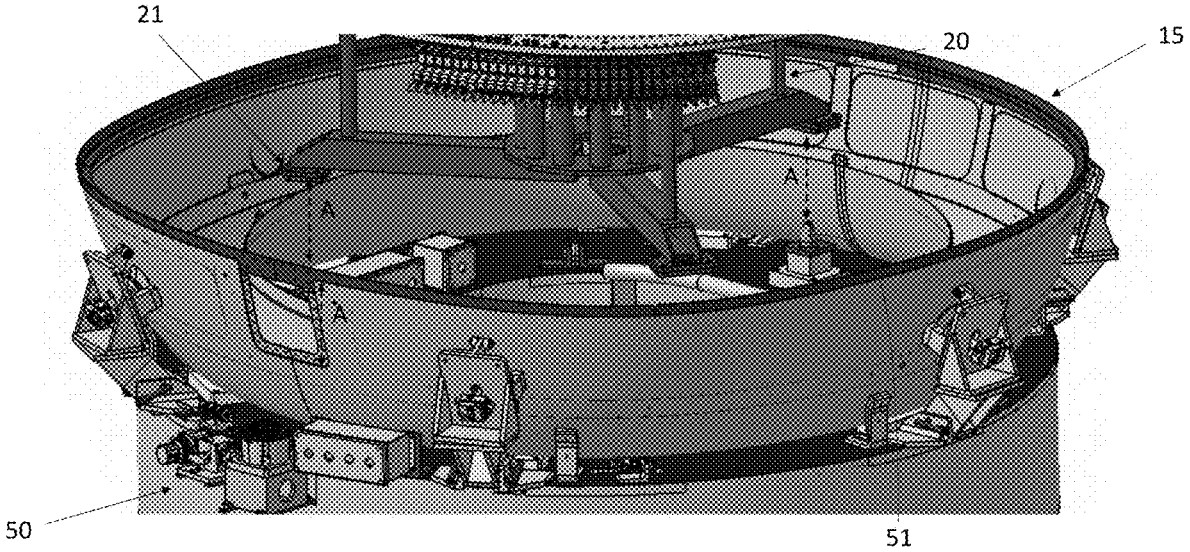
Figure 7:
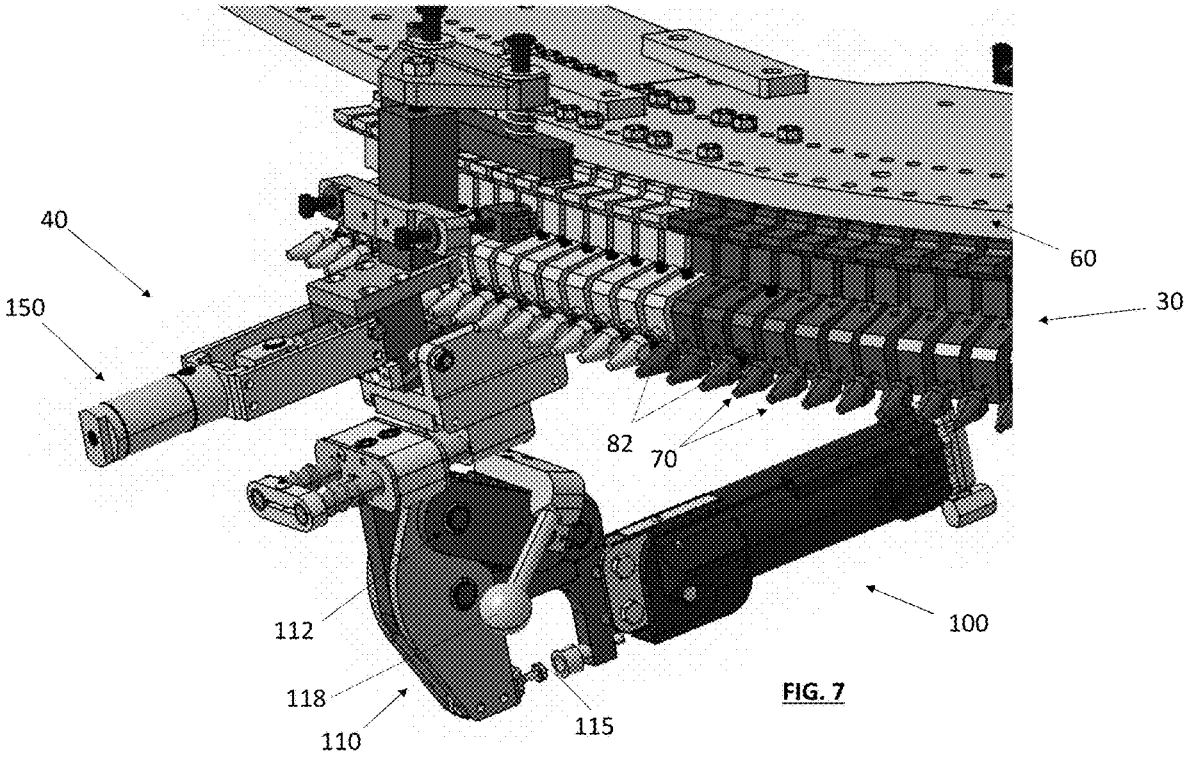
Figure 8:
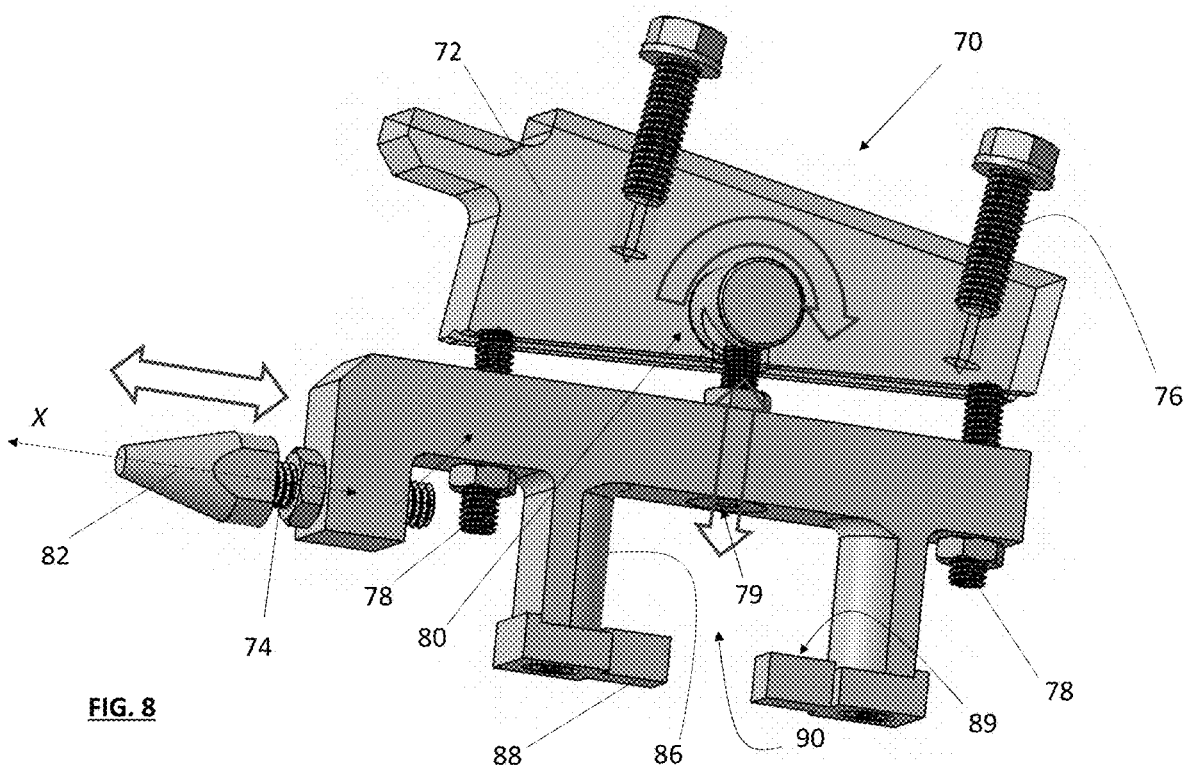
Figure 9:
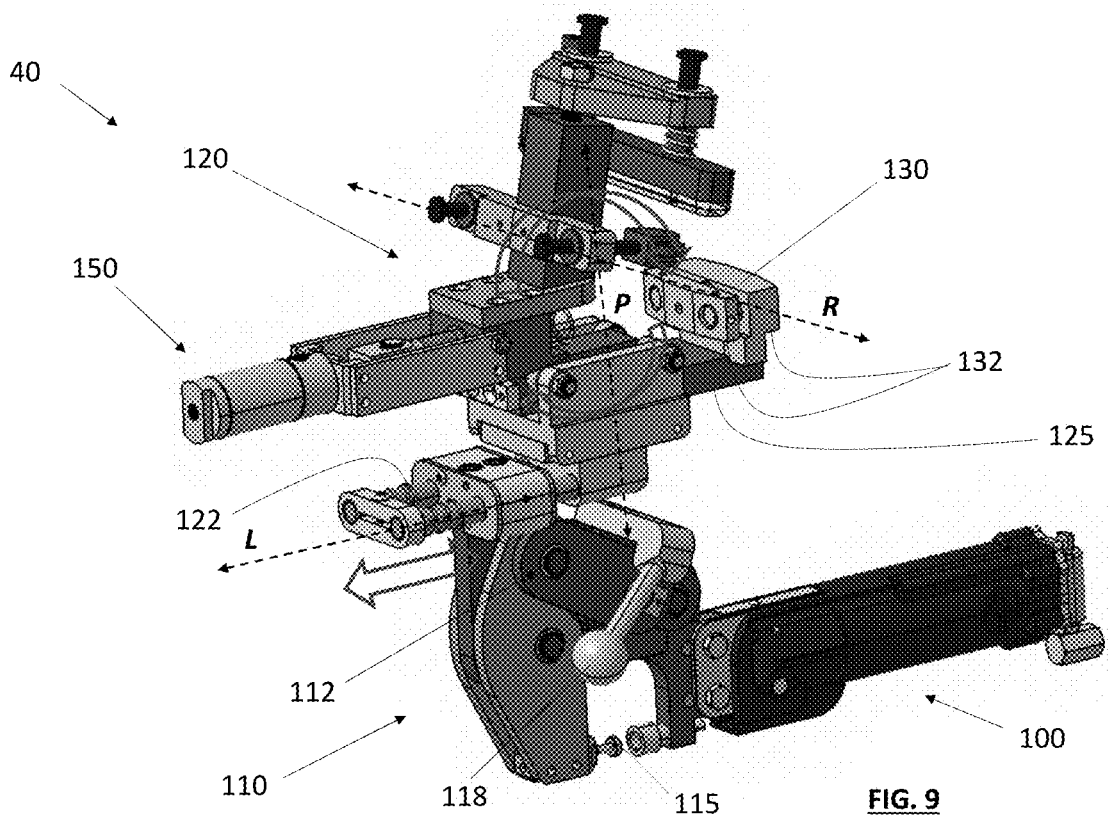
Figure 10:
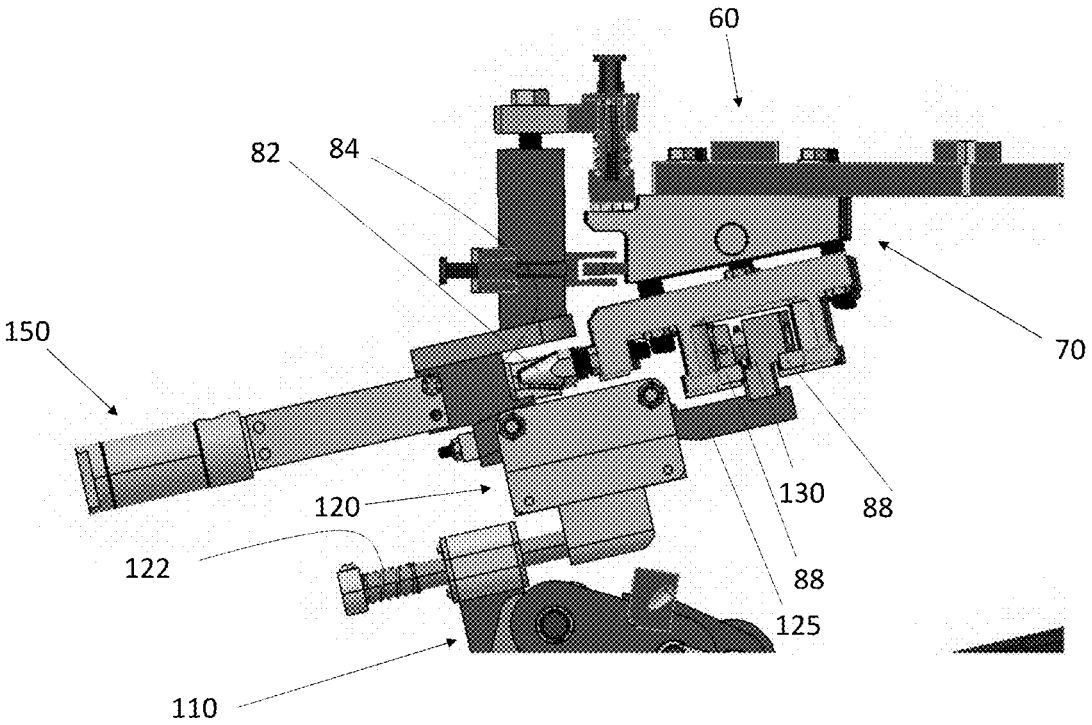
Figure 11:
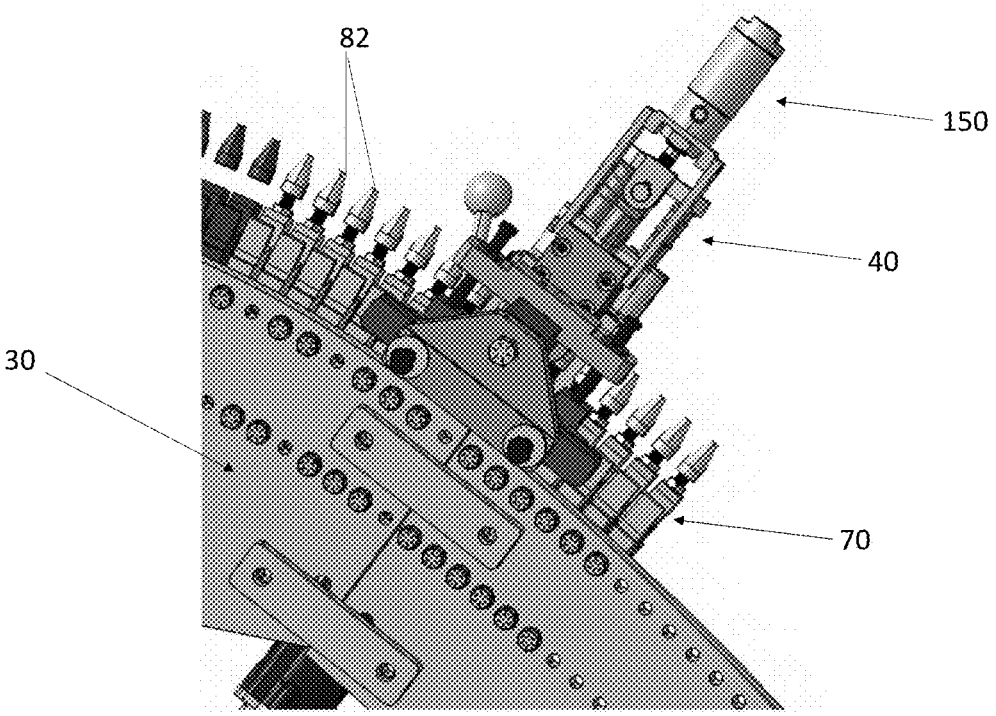
Figure 12:
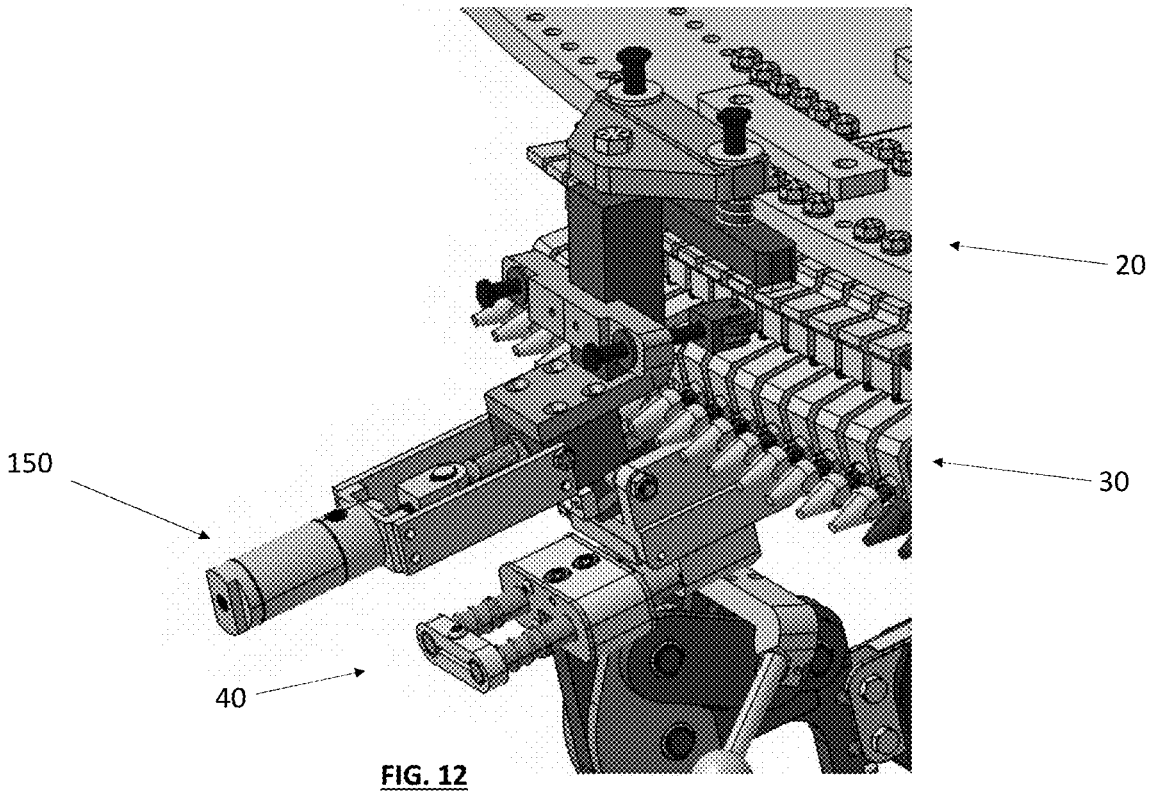
Figure 13:
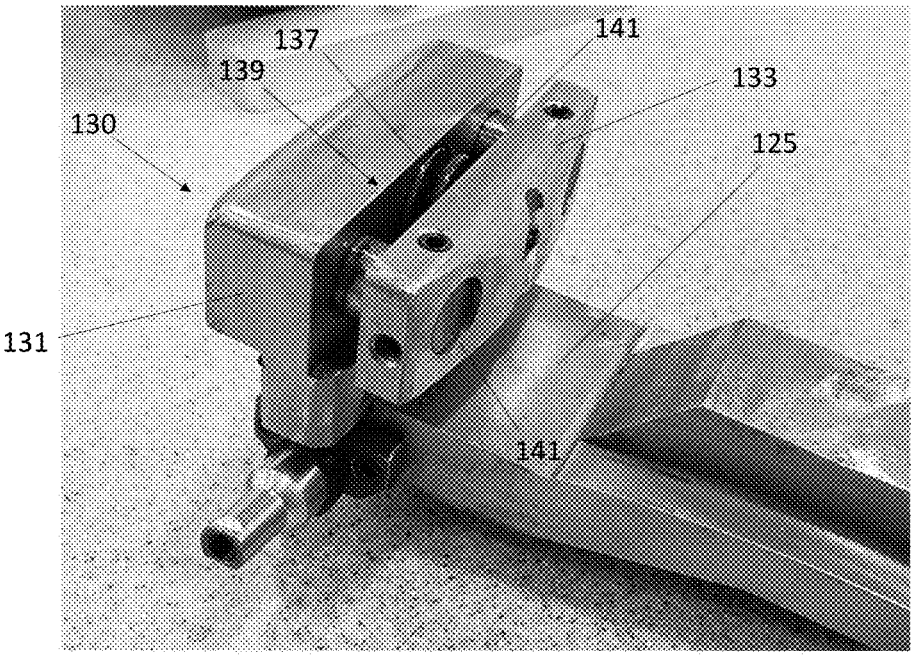
Figure 14:
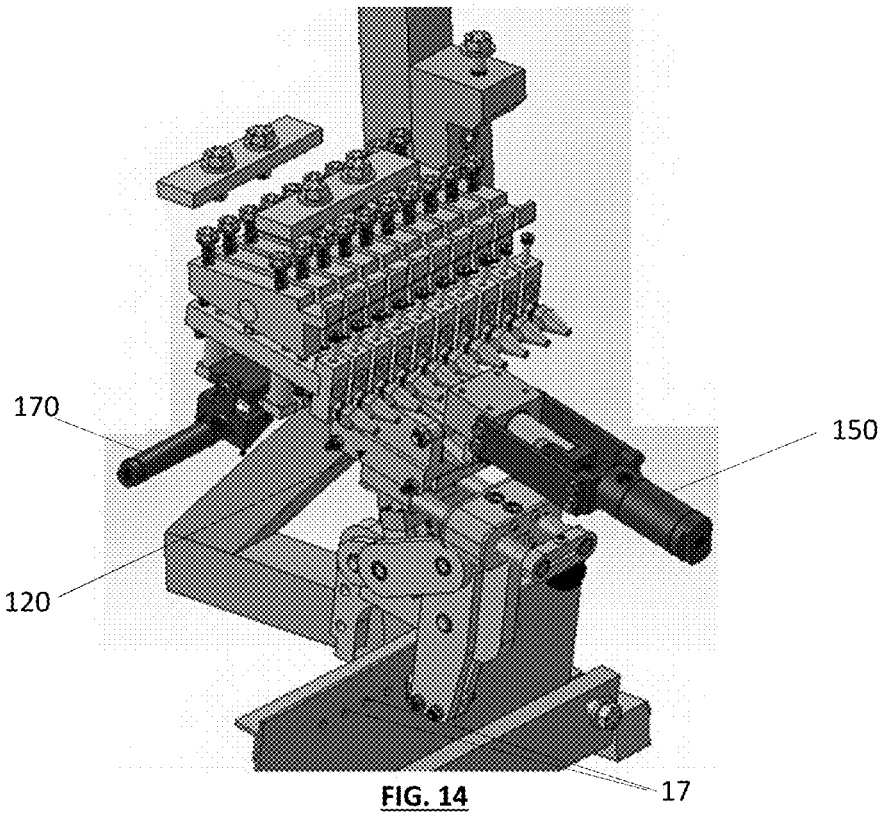
Figure 15:
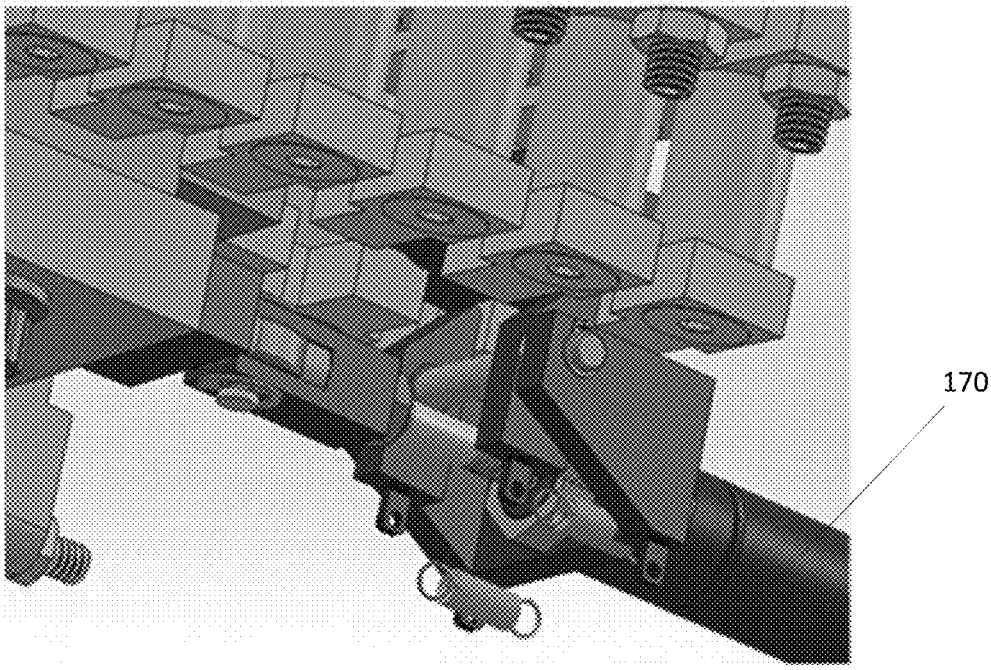
Figure 16:
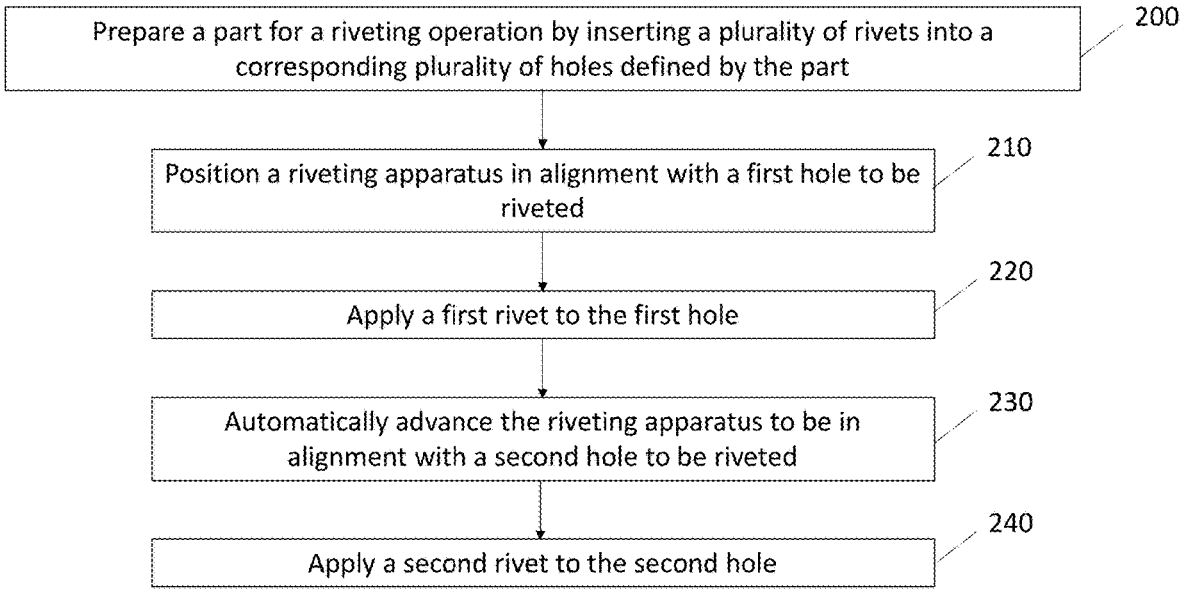

Having thus described example embodiments of the disclosure in general terms, reference will now be made to the accompanying drawings, which are not necessarily drawn to scale, and wherein:

FIG. 1 is a perspective view of an apparatus for automatically applying rivets to a part and a parts mount with a part to be riveted positioned thereon in accordance with an example embodiment of the present disclosure;

FIG. 1A is a close-up perspective view of a positioner of the parts mount shown in FIG. 1;

FIG. 2A is a close-up side view of rivets being applied to a part in accordance with an example embodiment of the present disclosure;

FIG. 2B is a close-up perspective view of rivets being applied to a part in accordance with an example embodiment of the present disclosure;

FIG. 3 is a perspective view of the apparatus of FIG. 1;

FIG. 4 is a perspective view of a central support member of the frame assembly of the apparatus of FIG. 1;

FIG. 4A is a close-up perspective view of brackets at the distal end of a support arm of the central support member of FIG. 4;

FIG. 4B is a close-up perspective view of a base element of the central support member of FIG. 4 with a securing bracket;

FIG. 4C is a top view of the apparatus of FIG. 1 as it is engaged with the part that is mounted to the parts mount in accordance with an example embodiment of the present disclosure;

FIG. 5 is a perspective view of a peripheral support member of the frame assembly of FIG. 1 in accordance with an example embodiment of the present disclosure;

FIG. 6 is a perspective view of a part secured to a parts mount with the apparatus displaced from the part in accordance with an example embodiment of the present disclosure;

FIG. 7 is a perspective view of a movable tool assembly and tool positioning assembly mounted to the peripheral support member of FIG. 5 in accordance with an example embodiment of the present disclosure;

FIG. 8 is a close-up view of a tool positioning module of the tool positioning assembly of FIG. 7 in accordance with an example embodiment of the present disclosure;

FIG. 9 is a perspective view of the movable tool assembly of FIG. 7 in accordance with an example embodiment of the present disclosure;

FIG. 10 is a side view of the movable tool assembly engaged with the tool positioning assembly via engagement of a T-bearing shoe of the movable tool assembly with a track formed by the tool positioning assembly in accordance with an example embodiment of the present disclosure;

FIG. 11 is a top view of the movable tool assembly engaged with the tool positioning assembly in accordance with an example embodiment of the present disclosure;

FIG. 12 is a close-up perspective view of the movable tool assembly of FIG. 11 showing a locking cylinder;

FIG. 13 is a close-up perspective view of a T-bearing shoe in accordance with an example embodiment of the present disclosure;

FIG. 14 is a perspective view of the movable tool assembly and the tool positioning assembly in position to perform a riveting operation on a part in accordance with an example embodiment of the present disclosure;

FIG. 15 is a close-up view of a move cylinder of the movable tool assembly of FIG. 14 in accordance with an example embodiment of the present disclosure; and FIG. 16 is a flow chart illustrating the operations performed in accordance with an example method for automated application of rivets to a part.

DETAILED DESCRIPTION

Some example embodiments of the present disclosure will now be described more fully hereinafter with reference to the accompanying drawings, in which some, but not all embodiments of the disclosure are shown. Indeed, various embodiments of the disclosure may be embodied in many different forms and should not be construed as limited to the embodiments set forth herein; rather, these example embodiments are provided so that this disclosure will be thorough and complete, and will fully convey the scope of the disclosure to those skilled in the art. Like reference numerals refer to like elements throughout. As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

As noted above, rivets are commonly used in manufacturing to permanently mechanically fasten two pieces of metal to each other. Taking the aerospace industry as an example, engine inlet lip skins are components used on modern airplane jet engines to reduce drag and produce laminar flow of the air entering the engine inlet. Lip skins are manufactured by fastening two typically large, circular, metal (e.g., aluminum) parts together using rivets. According to conventional techniques, the parts to be fastened are placed in a mount that holds the parts in relative alignment, and an operator then inserts a rivet in each set of aligned holes of the parts and applies each rivet by squeezing the actuator of a rivet gun. Once a rivet has been set in place and fastened, the operator will move to the next hole and repeat the process by aligning and inserting the rivet and squeezing the rivet gun actuator.

In the example noted above of an engine inlet lip skin, over 200 rivets may need to be applied to fasten the components used to make a single lip skin. The operator performing the riveting operation may in some cases hold the rivet gun in an incorrect location or at a wrong angle, which can create defects that require removal and replacement of the affected rivets. For example, if the rivet gun is not positioned normal or perpendicular to the outer surface of the assembly, an edge of the rivet die may contact the outer surface of the assembly when the riveter is actuated, causing dents or other imperfections in the outer surface. Moreover, the repeated motion that an operator must undertake to align, insert, and squeeze the rivet using the rivet gun can have negative physical and mental effects on the operator, including musculoskeletal defects (MSD).

Through applied skill and ingenuity, the inventor has devised an improved system and method of applying rivets for mechanically fastening parts that allows for accurate and reliable positioning and fastening of the rivets, particularly when a large number of rivets are involved, and removes the need for an operator to hand-squeeze each rivet in place. Although the description below and the figures included herein reference the aerospace industry and/or engine inlet lip skins for ease of explanation, it is to be understood by one skilled in the art in view of this disclosure that the apparatuses and methods described herein may be used to apply rivets to fasten metal plates to each other in any configuration using any number of rivets/rivet holes to accommodate needs in any number of industries.

Turning now to FIG. 1, an apparatus 10 for the automated application of rivets to a part 15 is shown. As noted above, for ease of explanation, the part 15 is illustrated as an engine inlet assembly. As used herein, the term "part" is meant to indicate two or more aligned pieces that will be fastened together. The apparatus 10 may include a frame assembly 20, a tool positioning assembly 30 that is attached to the frame assembly as described in further detail below, and a movable tool assembly 40 that is engaged with the tool positioning assembly. The movable tool assembly 40 may be configured to be moved with respect to the tool positioning assembly 30. The tool positioning assembly 30 may in turn be configured to be adjusted to correspond with a position of a plurality of rivet holes on the part 15 that is to be riveted. As such, the movable tool assembly 40 may be configured to sequentially align with each of the plurality of rivet holes via alignment with the tool positioning assembly 30 and to apply a rivet to each of the plurality of rivet holes, as described in greater detail below.

With continued reference to FIG. 1, in order to prepare for the riveting operation, the part 15 (e.g., the engine inlet assembly) may be placed in a parts mount 50 that is configured (e.g., sized and shaped) to receive and secure the part in place. For example, the parts mount 50 may include a base 52, a body 54, and one or more positioners 56 (shown in greater detail in FIG. 1A). The base 52 may include feet or other stabilizing structures for holding the parts mount 50 in an upright position and supporting the weight of the part 15 that is placed on the parts mount. The body 54 may be attached to the base 52 and may support the positioners 56, which may in turn be configured to receive and engage the part 15, as shown in FIGS. 1 and 1A. Each of the positioners 56 may, for example, include an adjustment knob 58 (shown in FIG. 1A) and/or other features that may be shortened or lengthened so as to more securely engage with the part 15 to be riveted and to hold the part in place during the riveting operation, as will be understood by one skilled in the art in view of this disclosure.

With reference to FIGS. 2A and 2B, the part 15 to be riveted includes multiple pieces 15*a*, 15*b*, each of which may include a plurality of rivet holes 17 (best shown in FIG. 14). The rivet holes 17 may be pre-formed (e.g., punched or drilled) in the part 15 and may be configured (e.g., sized and shaped) to receive a rivet therein. In the case of an engine inlet assembly, there may be upwards of 250 rivet holes pre-formed along a periphery of the part 15. Prior to the riveting operation, a rivet may be placed in each set of rivet holes 17 and, in some cases, temporarily held in place (e.g., via a temporary adhesive, such as tape) until the riveting operation has occurred to permanently fix the rivet to the part 15.

In a conventional riveting scenario, a rivet gun, which would include a rivet squeezer and a C-frame, would be manually used by an operator to apply each rivet to the part. In particular, the rivet squeezer would be actuated by the operator's hand via a trigger that is squeezed, which would cause the rivet to be applied to the part by pushing the head of the rivet toward the part being riveted. The C-frame, which may be a solid C-shaped member that includes an anvil or rivet die against which the headless end of the rivet is configured to strike when the rivet squeezer is actuated, would thus cause the shank of the rivet to be deformed, thereby permanently fixing the rivet to the part. This process, which requires the operator to visually align the rivet gun with the rivet and the rivet hole of the part, actuate the trigger of the rivet squeezer to apply the rivet, and then move the rivet gun to the next rivet to be applied to repeat the riveting operation, would thus be done manually by an operator. In the case of a large industrial part, such as the engine inlet assembly shown in the figures, which includes numerous rivets to be applied, this process can be time consuming, labor intensive, repetitive, mentally and physically stressful on the operator, and prone to operator error.

According to embodiments of the apparatus described herein, the rivet tool assembly can be positioned with respect to the part and automatically moved so as to sequentially align with each of the plurality of rivet holes and to apply a rivet to each of the plurality of rivet holes without requiring a user to visually align the tool with each hole in advance of the respective rivet being applied or to manually actuate the rivet squeezer to apply each rivet. Rather, the process of positioning and aligning the tool, applying each rivet to a respective rivet hole, and advancing the tool to the next rivet hole is done automatically once the apparatus is calibrated with respect to the type of part to be riveted. Thus, in FIGS. 2A and 2B, the rivet is not visible, as it has been received within a rivet squeezer 100 to perform the riveting operation according to embodiments of the present invention. As will be described in greater detail below, the rivet squeezer 100 thus cooperates with a C-frame 110 to apply the rivet to the rivet holes 17, but without requiring manual alignment, actuation of the rivet squeezer, or advancement of the rivet gun from one set of holes to the next.

Turning now to FIGS. 3-15, the frame assembly 20, the tool positioning assembly 30, and the movable tool assembly 40 of FIG. 1, which cooperate to position and align the rivet tool, apply each rivet to a respective rivet hole, and advance the tool to the next rivet hole as described above according to embodiments of the present invention, will be described in more detail.

In particular, the frame assembly 20 (shown in FIGS. 3 and 4-4C) is provided to stabilize and support the tool positioning assembly 30 and the movable tool assembly 40 with respect to the parts mount 50, upon which the part 15 to be riveted is placed. As such, in some embodiments, the frame assembly 20 comprises a central support member 22 (shown in FIG. 4) and a peripheral support member 60 (shown in FIG. 5). The central support member 22 may, in some cases, comprise a weldment (e.g., an assembly of pieces that are welded together). As illustrated in FIG. 4, in some embodiments the central support member 22 may comprise a structural core 24 and a plurality of base elements 23, such as three or four or more base elements, extending laterally from the base of the structural core 24. The structural core 24 may, for example, comprise a plurality of tubular members 25 that are vertically arranged in a circular fashion and that are supported and held together at their ends by support plates 26. Each base element 23 (shown in FIG. 4B) may comprise a securing bracket 21 that is configured to be fixed (e.g., via a bolt or other mechanical fastener) to an interior surface of the parts mount 50, as shown in FIG. 4C. In this way, the frame assembly 20 may be fixed in position with respect to the parts mount 50 and, in turn, with respect to the part 15 to be riveted.

In some embodiments, the frame assembly 20 may be lifted up and out of engagement with the parts mount 50 to provide clearance for a part 15 to be placed in and secured to the parts mount 50, as shown by arrows A in FIG. 6. Once the part 15 has been secured to the parts mount as described above, the frame assembly 20 may be moved down and into engagement (along arrows A) with the parts mount 50, such that (for example) the securing brackets 21 of the central support member 22 may be fixed to the parts mount 50 (e.g., via bolts or other fasteners engaging with holes 51 defined in the parts mount). In this way, the frame assembly 20 is configured to be moved between a non-operational position in which the apparatus 10 is spaced from the part 15 to be riveted and an operational position in which the apparatus 10 is engageable with the part 15 to be riveted. Accordingly, the peripheral support member 60 may further comprise an access structure 61 that operates in combination with an elevator assembly (not shown) to raise and lower the movable tool assembly 40, so as to provide clearance to the engine inlet assembly during craning operations for raising and lowering the frame assembly 20.

Turning again to FIG. 4, a plurality of support arms 27 may extend outwardly from the structural core 24 and may be configured to secure and support the peripheral support member (shown in FIGS. 4C and 5). For example, as shown in FIG. 4A, the distal end of each support arm 27 may comprise brackets 28 and bolts 29 configured to be attached to corresponding structures (e.g., holes) provided on the peripheral support member 60, such as via an underside of the peripheral support member 60 as shown in FIG. 3. Additional support arms 27 may extend between the base elements 23 and other support arms 27 and/or between the structural core 24 and/or the support plates 26 and other support arms 27 to provide additional rigidity and strength to the central support member 22 and to the frame assembly 20 overall.

With reference to FIG. 5, the shape of the peripheral support member 60 corresponds to a path defined by the series of rivets to be applied to the part 15 to be riveted. In the case of the depicted embodiment, in which rivets are to be applied to an engine inlet assembly, the peripheral support member 60 defines a circular shape. In other embodiments in which the path to be traveled by the rivet tool defines a different shape, such as a line, an arc, an oval, etc., the peripheral support member 60 may define a corresponding shape.

In some embodiments, the peripheral support member 60 may be formed of a single piece of material, whereas in other embodiments, such as the embodiment depicted in the figures, the peripheral support member may comprise a number of pieces that are fastened together to define the shape of the peripheral support member. In FIG. 5, for example, the peripheral support member 60 comprises twelve pieces 62 that are held together by splice plates 64. The size and number of pieces 62 may, in some cases, be dependent on manufacturing considerations, as well as the overall shape of the peripheral support member 60 that is required. The outer edge 66 of the peripheral support member 60 may further define a number of holes 68 in one or more rows (e.g., one row proximate the outer edge 66 of the peripheral support member 60 and another row inward of the outer edge 66, as shown in FIG. 5). Moreover, additional holes 69 may be provided at other locations, such as closer to an inner edge 65 of the peripheral support member 60, to allow for the central support member 22 (shown in FIG. 4) to be attached to the peripheral support member 60, as shown in FIG. 3.

With reference now to FIGS. 3 and 7, in some embodiments, the tool positioning assembly 30 may be attached to the peripheral support member 60. For example, the tool positioning assembly 30 may include a number of tool positioning modules 70 (shown in FIGS. 7 and 8). The number of tool positioning modules 70 may correspond to the number of rivet holes in the part 15 to be riveted. For example, in a part 15 that is an engine inlet assembly and that includes 274 rivet holes to be riveted, the tool positioning assembly 30 would include 274 tool positioning modules 70. In this way, each tool positioning module 70 may be configured to align and position the movable tool assembly 40 with a corresponding rivet hole so as to cause each rivet to be applied correctly to the corresponding rivet hole without operator intervention with respect to the alignment.

Accordingly, each tool positioning module 70 may include a positioning block 72 and a locking cone assembly 74. The positioning block 72 may be configured to be attached to the peripheral support member 60, such as via a fastener 76 (e.g., a threaded bolt) that passes through both the tool positioning module 70 and the peripheral support member 60 (shown fastened together in FIG. 7). The locking cone assembly 74, in turn, may be attached to the positioning block 72 via fasteners 78, 79. Accordingly, the fasteners 78, 79 may be used to adjust an elevation and an angle of the locking cone assembly 74 with respect to the positioning block 72. For example, the fastener 79 (which may be a threaded fastener, as depicted in FIG. 8) may be shortened or lengthened via the barrel nut 80 to adjust a gross elevation (e.g., vertical spacing between the positioning block 72 and the locking cone assembly 74), in combination with adjustments of the outward fasteners 78 to make changes in the angle of the positioning block 72 with respect to the locking cone assembly 74. Accordingly, in some embodiments, an angle and an elevation of each locking cone assembly 74 may be independently adjustable with respect to an angle and an elevation of other locking cone assemblies. As will be described in greater detail below, this adjustment mechanism may be one of the available adjustment mechanisms for aligning the tool positioning module 70 with a respective rivet hole, such that the movable tool assembly 40 will be aligned with the rivet hole.

In some embodiments, the locking cone assembly 74 of each tool positioning module 70 may support a locking cone 82. The locking cone 82 may be configured to be received by a locking cone receiver 84 of the movable tool assembly 40, shown in FIG. 7, as will be described in greater detail below. In some embodiments, an axial displacement of each locking cone 82 may be independently adjustable with respect to an axial displacement of other locking cones (e.g., locking cones supported by other tool positioning modules). In this regard, a position of the locking cone 82 may be adjustable along an axis X shown in FIG. 8 (e.g., it may be adjusted to be located closer to or farther from the locking cone assembly 74). For example, the locking cone 82 may be connected to the locking cone assembly 74 via a threaded fastener, such that threading the locking cone 82 farther along the fastener may move the locking cone 82 toward the locking cone assembly 74, whereas unthreading the locking cone 82 from the fastener (backing it out) may move the locking cone 82 away from the locking cone assembly 74. In this way, a depth, or lateral limit for the position of the movable tool assembly 40, may be set, such that the movable tool assembly 40 may not be moved closer the respective tool positioning module 70 than allowed by the position of the locking cone 82. The setting of this depth via adjustment of the position of the locking cone 82 may be considered a second adjustment mechanism for aligning the movable tool assembly 40 with the corresponding rivet hole.

The locking cone assembly 74 may comprise an engagement mechanism configured to slidably receive a T-bearing shoe (described below) of the movable tool assembly 40 for supporting the movable tool assembly and allowing the movable tool assembly to slide from one tool positioning module to the next. For example, the locking cone assembly 74 may comprise a pair of spaced apart extensions 86, and each extension 86 may include a foot 88 attached to its distal end, as shown in FIG. 8. The feet 88 may be oriented with respect to each other so as to define a space 90 therebetween, and an upper surface 89 of each foot 88 in the opposing pair of feet may cooperate to serve as a track for supporting and guiding (e.g., slidably receiving) the T-bearing shoe of the movable tool assembly 40, as described below.

With reference now to FIG. 9, the movable tool assembly 40 will be described. The movable tool assembly 40 is configured to be moved from one tool positioning module 70 of the tool positioning assembly 30 to the next tool positioning module 70 (e.g., moving sequentially from one module to the next in order to align the rivet squeezer with each subsequent corresponding rivet and rivet hole to perform the riveting operation on the part 15). The movable tool assembly 40 may thus be configured to operationally engage a rivet squeezer 100. The rivet squeezer 100 may be a conventional rivet squeezer that is configured to apply the requisite force to a rivet for pushing the rivet against an anvil to deform the headless end of the rivet and mechanically fasten the part 15 being riveted.

Accordingly, the movable tool assembly 40 may comprise a C-frame 110 configured to be attached to the rivet squeezer 100. In some embodiments, the C-frame 110 may comprise a hinge 112 configured to allow the C-frame to be opened and closed. In the open position, for example, the C-frame 110 may be configured to receive the part 15 to be riveted. For example, in the open position, the C-frame 110 may be placed over or around the part 15 to be riveted, such as on a lip skin of an engine inlet assembly, as shown in FIG. 1. In the closed position, after the C-frame 110 has been positioned with respect to the part 15 to be riveted, the C-frame may be ready for the riveting operation. As shown in FIGS. 7 and 9, a handle 118 may be provided on the C-frame. The handle 118 may be used to allow the C-frame 110 to be moved between the open position and the closed position via rotation about the hinge 112 or to lock the C-frame in the closed position. The C-frame 110 may further comprise an anvil 115, which may be configured to engage the headless end of the rivet being applied as a result of actuation of the rivet squeezer 100. Upon impact of the headless end of the rivet with the anvil 115, the rivet may thus be deformed and secured to the part to be riveted, as described above. Accordingly, in the closed position of the C-frame 110, actuation of the rivet squeezer will serve to move the rivet into contact with the anvil 115 for deforming the rivet during a riveting operation.

As shown in FIG. 9, the movable tool assembly 40 may further comprise a mounting assembly 120 attached to the C-frame 110, such as via threaded members 122. In some embodiments, for example, a pair of threaded members 122 may be used to connect the C-frame 110 to the mounting assembly 120. In addition to securing the C-frame 110 to the mounting assembly 120, the threaded members 122 may be used to adjust a lateral position of the C-frame with respect to the tool positioning assembly 30 described above and shown in FIG. 7. In this way, the movable tool assembly 40 may be adjustable with respect to a longitudinal axis L of the movable tool assembly (FIG. 9). In some embodiments, the movable tool assembly 40 may be further self-adjustable with respect to a pitch axis P and/or a roll axis R of the movable tool assembly, as shown in FIG. 9 and as described in greater detail below. In this way, embodiments of the present invention allow the rivet tool to self-align and self-normalize to a position normal to the surface of the part to be riveted with respect to the longitudinal axis of the rivet.

The mounting assembly 120 may comprise a lateral extension 125, extending in the direction of the tool positioning assembly 30 (shown in FIG. 7). The lateral extension 125 may be configured to support a T-bearing shoe 130, as shown in FIG. 9. The T-bearing shoe 130, in turn, may be configured to fit within the space 90 formed by the feet 88 of the locking cone assembly 74, such that a bearing surface 132 of the T-bearing shoe 130 may slidingly engage the upper surface 89 of each foot 88, which serve as the track for the T-bearing shoe. A side view of the mounting assembly 120, showing how the T-bearing shoe engages the track formed by the feet 88 of the plurality of tool positioning modules 70 described above, is shown in FIG. 10.

Turning again to FIG. 9, the mounting assembly 120 may further comprise the locking cone receiver 84 described above, which is configured to engage the locking cone 82 shown in FIG. 8. Through engagement of the locking cone receiver 84 with the locking cone 82, which has been pre-calibrated to approximate the position and angle of the corresponding rivet hole, the movable tool assembly 40 may be aligned with the corresponding rivet hole for optimizing the riveting operation that takes place when the rivet squeezer is actuated. Moreover, as noted above, in some embodiments, the movable tool assembly 40 is self-adjustable with respect to at least one of the longitudinal axis L, the roll axis R, or the pitch axis P of the movable tool assembly upon engagement of the locking cone receiver 84 with a corresponding locking cone 82, such that self-adjustment results in normalization of the movable tool assembly 40 with respect to a surface of the part to be riveted at a location of the respective rivet hole. For example, the mounting assembly 120 of the movable tool assembly 40 may comprise a bearing (not shown) that allows for rotation of the movable tool assembly about the P axis (FIG. 9). In addition, cam rollers may be provided on a machined curved surface of the mounting assembly 120 that provide for rotation about the R axis of FIG. 9. In this way, the locking cone receiver 84 of the movable tool assembly 40 is configured to be moved into engagement with each locking cone 82, and engagement of the locking cone receiver 84 with each of the plurality of locking cones 82 serves to position the movable tool assembly 40 in alignment with a corresponding one of the plurality of rivet holes for applying a rivet to the respective rivet hole.

FIG. 13 illustrates a T-bearing shoe 130 in a position/orientation corresponding to the perspective of FIG. 14. According to some embodiments, the T-bearing shoe 130 comprises a fixed portion 131 and a movable portion 133. A compression spring 137 is attached to the opposing surfaces of the fixed and movable portions 131, 133, thereby connecting the two portions and allowing them to move toward and away from each other, closing or opening the gap 139 between the two portions, respectively. Guiding pins 141 may be provided that extend from one of the portions (e.g., the fixed portion 131 as depicted) through corresponding holes 143 in the opposite portion (e.g., the movable portion 133 as depicted) to stabilize the two portions 131, 133 with respect to each other as the compression spring 137 is compressed or relaxed and the portions are moved toward or away from each other as a result.

With reference to FIGS. 14 and 15, the movable tool assembly 40 is configured to move from one tool positioning module 70 to the next for sequentially applying rivets to each subsequent rivet hole. The movable tool assembly 40 may be pneumatically, electrically, or hydraulically actuated. As shown in FIGS. 11, 12, 14, and 15, in some embodiments, such as in embodiments in which the apparatus 10 is pneumatically actuated, a pneumatic source may be connected to three pneumatic cylinders for actuating different parts of the apparatus. For example, the apparatus may be connected to a locking cylinder 150 (shown in FIGS. 2A and 2B) configured to actuate a mechanism that locks the movable tool assembly with respect to the tool positioning assembly for alignment with a respective hole; a rivet cylinder 160 configured to actuate the rivet squeezer of the apparatus to apply a respective rivet; and a move cylinder 170 configured to actuate the advancement mechanism described above with reference to FIGS. 14 and 15.

In such embodiments, applying the first rivet to the first hole may comprise moving the locking cylinder 150 to an operational position, thereby locking the movable tool assembly with respect to the tool positioning assembly for alignment with the first hole. In particular, when the locking cylinder 150 is actuated, the locking cone receiver 84 is moved into engagement with the locking cone 82 (FIG. 10). The force generated by this movement is absorbed by the compression spring 137 of the T-bearing shoe 130 (FIG. 13). The rivet cylinder 160 may then be moved to the operational position, thereby actuating the rivet squeezer and applying the first rivet to the first hole. At the completion of the rivet operation, the rivet cylinder 160 is moved to a non-operational position, which serves to disengage the riveting apparatus from the rivet. The locking cylinder 150 is then moved to a non-operational position. As a result, the compression spring 137 decompresses and, in turn, the locking cone receiver 84 disengages from the locking cone 82, releasing the movable tool assembly 40 such that actuation of the move cylinder 170 will advance the movable tool assembly to the next tool positioning module 70.

As a result of the sequential actuation of each of the locking cylinder 150, the rivet cylinder 160, and the move cylinder 170 as described above, the movable tool assembly 40 is advanced from a current position to a subsequent position corresponding to a subsequent rivet hole for performing a riveting operation at the subsequent position on the subsequent rivet hole.

Referring again to FIG. 1, the apparatus 10, which includes the frame assembly 20, the tool positioning assembly 30, and the movable tool assembly 40, may be prepared for a riveting operation on a part 15 to be riveted (e.g., an engine inlet assembly) by an operator according to a series of steps. In some embodiments, for example, the apparatus 10 may be lifted out of engagement with the parts mount 50. With the apparatus 10 lifted and out of the way, the part 15 may be loaded and secured to the parts mount 50 at a predefined (e.g., pre-marked) location and/or orientation. The apparatus 10 may then be lowered and indexed to the location and/or orientation of the part 15.

Once the apparatus 10 has been positioned with respect to the part 15 to be riveted, and once the locking cones 82 of the individual tool positioning modules 70 have been calibrated with respect to their respective rivet holes, an operator may follow a series of steps to operate the apparatus 10 such that the moveable tool assembly 40 is able to advance along the tool positioning assembly 30 to apply rivets sequentially to each rivet hole. In some embodiments, for example, the movable tool assembly 40 may be moved into position with respect to the first rivet hole to be riveted. The C-frame 110, which may have been opened to receive the part 15 to be riveted, may be closed, and the rivet squeezer may be pushed to its first position and locked with respect to the tool positioning module. In the case of a pneumatically actuated apparatus 10, as described above, the air from the pneumatic source may be connected to the apparatus, causing the rivet squeezer to apply the first rivet. Through continual actuation of the apparatus, upon each application of a rivet to a hole, the movable tool assembly may be advanced to the next tool positioning module for the next rivet to be applied until each rivet of the part has been applied. The air from the pneumatic source may then be disconnected, and the C-frame may be opened. The movable tool assembly 40 may then be raised to a non-operational position with respect to the part, and the apparatus 10 may then be lifted up and out of the way so that the part (now riveted) may be removed from the parts mount 50.

With reference to FIG. 16, a method for automated application of rivets to a part will now be described. According to embodiments of the method, a part may be prepared for a riveting operation at Block 200 by inserting a plurality of rivets into a corresponding plurality of holes defined by the part (e.g., manually, by an operator). A riveting apparatus, such as the apparatus 10 of FIG. 1, may then be positioned in alignment with a first hole to be riveted at Block 210, as described above. At Block 220, a first rivet may be applied to the first hole.

The riveting apparatus may then be automatically advanced to be in alignment with a second hole to be riveted at Block 230, and a second rivet may be applied to the second hole at Block 240. This process, e.g., automatic advancement and application of a rivet to each subsequent hole, may be repeated until each hole with a prepared rivet has been permanently fastened via the rivet, as described above. In other words, the method may thus serve to sequentially apply each of the plurality of rivets to a corresponding one of the plurality of holes to mechanically fasten the part.

As noted above, embodiments of the riveting apparatus 10 (as shown in FIG. 1) may comprise a frame assembly, a tool positioning assembly attached to the frame assembly, and a movable tool assembly engaged with the tool positioning assembly and configured to be moved with respect to the tool positioning assembly. As such, positioning the riveting apparatus in alignment with the first hole to be riveted, as described with reference to Block 210 of FIG. 16, may comprise lowering the frame assembly into engagement with the part to be riveted. Moreover, in some embodiments, positioning the riveting apparatus in alignment with the first hole to be riveted may further comprise adjusting the tool positioning assembly to correspond with a position of the plurality of rivet holes on the part to be riveted.

In some embodiments, such as in embodiments in which the apparatus 10 is pneumatically actuated, a pneumatic source may be connected to three pneumatic cylinders for actuating different parts of the apparatus. For example, as described above, the apparatus 10 may be connected to a locking cylinder configured to actuate a mechanism that locks the movable tool assembly with respect to the tool positioning assembly for alignment with a respective hole; a rivet cylinder configured to actuate the rivet squeezer of the apparatus to apply a respective rivet; and a move cylinder configured to advance the movable tool assembly to the next position, as described above with reference to FIGS. 14 and 15. In such embodiments, applying the first rivet to the first hole may comprise moving the locking cylinder to an operational position, thereby locking the movable tool assembly with respect to the tool positioning assembly for alignment with the first hole. In such cases, applying the first rivet to the first hole may further comprise moving the rivet cylinder to the operational position, thereby actuating the rivet squeezer and applying the first rivet to the first hole; moving the rivet cylinder to a non-operational position, thereby disengaging the riveting apparatus from the first rivet and the first rivet hole; and moving the locking cylinder to a non-operational position, thereby allowing the movable tool assembly to be advanced to the second hole. In some embodiments, automatically advancing the riveting apparatus to be in alignment with a second hole to be riveted, such as described with reference to Block 230 of FIG. 16, may comprise actuating the move cylinder to advance the movable tool assembly into alignment with the second hole.

In some embodiments, automatically advancing the riveting apparatus to be in alignment with a second hole to be riveted, such as described with reference to Block 230 of FIG. 16, may comprise actuating the move cylinder to advance the movable tool assembly into alignment with the second hole.

Many modifications and other embodiments of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed is:

1. An apparatus for automated application of rivets to a part, the apparatus comprising:

a frame assembly defining a periphery;

a tool positioning assembly attached to the frame assembly and comprising a plurality of tool positioning modules, each tool positioning module of the plurality of tool positioning modules comprising a locking cone assembly comprising a locking cone;

a movable tool assembly engaged with the tool positioning assembly and configured to be moved with respect to the tool positioning assembly and the frame assembly about the periphery of the frame assembly, wherein the tool positioning assembly is configured to be adjusted to correspond with a position of a plurality of rivet holes on a part to be riveted, and wherein the movable tool assembly is configured to move relative to the part to be riveted to sequentially align with each of the plurality of rivet holes via alignment with the tool positioning assembly and to apply a rivet to each of the plurality of rivet holes;

wherein the movable tool assembly comprises a locking cone receiver configured to be moved into engagement with a respective locking cone and wherein engagement of the locking cone receiver with the respective locking cone positions the movable tool assembly in alignment with a respective rivet hole for applying a rivet to the respective rivet hole.

2. The apparatus of claim 1, wherein the frame assembly comprises a central support member and a peripheral support member affixed to the central support member, and wherein the tool positioning assembly is attached to the peripheral support member.

3. The apparatus of claim 2, wherein the tool positioning assembly defines a circular shape about the periphery of the frame assembly.

4. The apparatus of claim 1, wherein an axial displacement of each of the locking cones is independently adjustable with respect to an axial displacement of a remainder of the locking cones.

5. The apparatus of claim 4, wherein an angle and an elevation of the locking cone assembly of each tool positioning module is independently adjustable with respect to an angle and an elevation of the remainder of the locking cone assemblies.

6. The apparatus of claim 1, wherein the movable tool assembly is self-adjustable with respect to at least one of a longitudinal axis, a roll axis, or a pitch axis of the movable tool assembly upon engagement of the locking cone receiver with the respective locking cone, such that self-adjustment results in normalization of the movable tool assembly with respect to a surface of the part to be riveted at a location of the respective rivet hole.

7. The apparatus of claim 1, wherein the movable tool assembly comprises a T-bearing shoe and each of the locking cone assemblies comprise a track configured to slidably receive the T-bearing shoe.

8. The apparatus of claim 7, wherein each tool positioning module comprises a pair of extensions, each extension comprising a foot, wherein the pair of extensions and feet from the track for slidably receiving the T-bearing shoe.

9. The apparatus of claim 7, wherein the T-bearing shoe comprises a fixed portion, a movable portion spaced from and movable with respect to the fixed portion, and a compression spring attached to the fixed portion and the movable portion and disposed therebetween.

10. The apparatus of claim 1, wherein the movable tool assembly is pneumatically, electrically, or hydraulically actuated.

11. The apparatus of claim 1, wherein the frame assembly is configured to be moved between a non-operational position in which the apparatus is spaced from the part to be riveted and an operational position in which the apparatus is engageable with the part to be riveted.

12. The apparatus of claim 1, wherein the movable tool assembly comprises a C-frame configured to be attached to a rivet squeezer, wherein the C-frame comprises a hinge, wherein the C-frame is configured to be moved between an open position and a closed position via rotation about the hinge, wherein in the open position the C-frame is configured to receive the part to be riveted, and wherein the C-frame further comprises an anvil, such that in the closed position, actuation of the rivet squeezer moves the rivet into contact with the anvil for deforming the rivet during a riveting operation.

13. The apparatus of claim 1, wherein the part to be riveted is an engine inlet assembly.

14. An apparatus for automated application of rivets to a part, the apparatus comprising:

a frame assembly defining a periphery;

a tool positioning assembly attached to the frame assembly; and a movable tool assembly engaged with the tool positioning assembly and configured to be moved with respect to the tool positioning assembly and the frame assembly about the periphery of the frame assembly, wherein the tool positioning assembly is configured to be adjusted to correspond with a position of a plurality of rivet holes on a part to be riveted, wherein the movable tool assembly is configured to move relative to the part to be riveted to sequentially align with each of the plurality of rivet holes via alignment with the tool positioning assembly and to apply a rivet to each of the plurality of rivet holes;

wherein the movable tool assembly comprises a C-frame configured to be attached to a rivet squeezer, wherein the C-frame comprises a hinge, wherein the C-frame is configured to be moved between an open position and a closed position via rotation about the hinge, wherein in the open position the C-frame is configured to receive the part to be riveted, and wherein the C-frame further comprises an anvil, such that in the closed position, actuation of the rivet squeezer moves the rivet into contact with the anvil for deforming the rivet during a riveting operation.

15. The apparatus of claim 14, wherein the movable tool assembly is pneumatically, electrically, or hydraulically actuated.

16. The apparatus of claim 14, wherein the frame assembly comprises a central support member and a peripheral support member affixed to the central support member, and wherein the tool positioning assembly is attached to the peripheral support member.

17. The apparatus of claim 16, wherein the tool positioning assembly defines a circular shape about the periphery of the frame assembly.

18. The apparatus of claim 14, wherein the frame assembly is configured to be moved between a non-operational position in which the apparatus is spaced from the part to be riveted and an operational position in which the apparatus is engageable with the part to be riveted.

19. The apparatus of claim 14, wherein the part to be riveted is an engine inlet assembly.

20. The apparatus of claim 14, wherein each tool positioning module of the plurality of tool positioning modules comprising a locking cone assembly comprising a locking cone.

* * * * *